US005199957A

United States Patent [19]

Pascoe

[11] Patent Number: 5,199,957

[45] Date of Patent: Apr. 6, 1993

[54] COLORED TEXTILE FABRIC HAVING PARTIALLY REMOVABLE PIGMENT COATING

[75] Inventor: William M. Pascoe, Inman, S.C.

[73] Assignee: Milliken Research Corporation, Spartanburg, S.C.

[21] Appl. No.: 781,853

[22] Filed: Oct. 24, 1991

[51] Int. Cl.[5] ..... D06P 5/00

[52] U.S. Cl. ..... 8/478; 8/537; 8/552; 8/558; 8/637.1

[58] Field of Search ..... 8/478, 537, 552, 637.1, 8/552, 558, 478

[56] References Cited

U.S. PATENT DOCUMENTS 4,822,376 4/1989 Tucci ..... 8/478

*Primary Examiner*—A. Lionel Clingman

*Attorney, Agent, or Firm*—Timothy J. Monahan; H. William Petry

[57] ABSTRACT

A pre-dyed textile fabric is coated with a pigment and binder composition wherein the binder, binder to pigment ratio and cure conditions are selected to permanently fix only a portion of the pigment to the fabric. The balance of pigment not fixed to the fabric is easily removed in subsequent washing to provide a tone on tone effect which lasts during the life of the fabric.

9 Claims, No Drawings

COLORED TEXTILE FABRIC HAVING PARTIALLY REMOVABLE PIGMENT COATING

BACKGROUND OF THE INVENTION

This invention relates generally to a textile fabric colored with a resin-bonded pigment, and particularly to a fabric which is dyed a first color prior to application of the resin-bonded pigment. Preferably, the level of fixation of the pigment is adjusted to allow removal of a substantial portion of the pigment during normal wash conditions, thereby exposing the underlying first color of the fabric.

The concept of fixing a pigment to a textile fabric with a film of binder is well known in the textile arts. These resin-bonded pigment systems or pigment printing systems generally fall into one of four distinct types:

1. Aqueous dispersion systems;
2. Solvent dispersion systems;
3. Water-in-oil emulsion systems; and
4. Oil-in-water emulsion systems.

Emulsion systems are used predominantly. Pigment Handbook, Vol.II, Applications and Markets, pp. 335–353 (1973).

The desirable characteristics of a resin-bonded pigment system are ease of application, permanent attachment of the pigment to the fabric and minimal effect on the hand and performance of the fabric. The permanence of the pigment on the fabric is typically referred to in terms of washfastness, resistance to abrasion and crocking (rubbing off of pigment from the fabric). There are a variety of binder systems available which provide virtually permanent fixation of the pigment to the fabric, especially cellulosic fabric, throughout the fabric's life. On a solids basis, typical binder to pigment ratios are in the range of 2.5:1 to 4:1.

Recent trends in fashion have been to provide garments which have been dyed or pigment printed followed by treatment to partially remove the coloration. For example, "stone washed" denim may be prepared by abrading the color from the surface of a fabric by washing the fabric in the presence of small stones or pumice. Removing the color from the fabric reveals the natural color of the fibers underneath, usually cotton. Alternatively, dyed fabric may be "acid washed" in an acidic medium to create a mottled effect by partial degradation of the fabric fibers and loss of colorant.

A weathered effect has also been achieved by overdying a fabric with pigment colors which wash down during laundering. However, since the pigment is not fixed to the fabric with a binder, the pigment continues to wash down over the life of the fabric.

Methods of pigment printing on precolored or predyed fabrics are known. The pigment and binder system is selected to create a permanent pattern of the fabric. For example, in Daniels, U.S. Pat. No. 4,526,107, a pigment paste and binder system containing an opacifier is provided which is useful for printing over dark background shades. The printing paste forms an opaque, washfast pattern which completely hides the underlying color.

A pigment printing system comprising a dye which is released or flushed upon being wetted to create a bleeding effect is disclosed in Tucci, U.S. Pat. No. 4,822,376. However, though the dye is released, the pigment is bound to the fabric to create a permanent pattern.

SUMMARY OF THE INVENTION

Therefore, one of the objects of this invention is to provide a pre-colored textile fabric which has a pigment coating fixed thereto.

Another object of this invention is to adjust the parameters which determine the degree of fixation of the pigment to allow removal of a substantial portion of the pigment from a pre-colored fabric to expose the underlying color.

Another object of the invention is to remove the portion of pigment which is not fixed to the fabric by ordinary washing.

Still another object of the invention is to fix enough of the pigment to the fabric to partially cover the fabric during the fabric's useful life.

Yet another object of the invention is to provide a fabric which has significant contrast between the color of the underlying pre-colored fabric and the pigment fixed to the surface of the fabric.

Accordingly, a textile fabric is provided which is the product of applying a composition of a pigment and binder system to an area of a pre-colored, preferably pre-dyed fabric and heating the fabric to cure the binder. The parameters affecting the degree of pigment fixation, i.e. the binder to pigment ratio, binder system and cure conditions, are selected to achieve fixation of only a portion of the pigment applied to the fabric. The balance of the pigment applied to the fabric, which is not fixed, is removed by subjecting the fabric to mechanical agitation, preferably by agitation in an aqueous liquid, as in a washing machine. Approximately, 20 to 80 wt. % of the pigment applied to the fabric is removed, and preferably from 30 to 70 wt. % is removed.

The color of pigment selected is preferably different than the underlying color of the fabric. The initial application of the pigment binder composition may be applied in an amount sufficient to cover the underlying color. Partial removal of the pigment reveals the underlying color while providing a contrast with the color of the pigment overcoat. The look of the fabric suggests an iridescence or a two tone effect which is more subtle than that achieved with abrasion of the color from the surface of the fabric.

An advantage of this invention is that the pigment overcoat may be partially removed from the fabric without abrading the fibers or altering the underlying color.

Another advantage of the invention is that the binder to pigment ratio, binder system and cure conditions can be adjusted to control the percentage of pigment which is permanently fixed to the fabric and thus control the "washed out" look achieved as more of the underlying color is exposed.

The invention features removal of the pigment which has not been fixed to the fabric in a conventional washing machine. However, because a portion of the pigment overcoat is permanently fixed to the fabric, a garment made from the fabric will not continue to wash down during the life of the garment.

DESCRIPTION OF THE PREFERRED EMBODIMENT OF THE INVENTION

Without limiting the scope of the invention, the preferred features of the invention are hereinafter set forth.

The pigment and binder system of the present invention is applied to a pre-colored textile fabric, referred to as the base or underlying color of the fabric. A wide variety of textile fabrics may be used, including wovens, knits, and non-wovens, made from natural fibers, synethetic fibers, or blends. Preferably, the textile fabric is a woven construction of cellulosic fibers or blends thereof. By way of example, the fabric may be cotton, rayon or linen, any of which may be blended with synthetic fibers such as polyester.

The fiber selection will prescribe the method used to pre-color the fabric. Those skilled in the art will readily ascertain appropriate technique to provide a washfast base color to the fabric, such as the use of acid dyes, direct dyes, disperse dyes, fiber reactive dyes premetallized dyes, vat dyes and pigments. For example, 100% cotton fabric may be prepared by conventional desizing, scouring, bleaching and mercerizing, followed by conventional, continuous vat dyeing. Alternatively, the fabric may be constructed from "yarn dyed" fibers.

The pre-colored fabric is coated with a composition containing a pigment and binder sytem. The composition may be applied in a pattern to selected areas or may uniformly coat a side of the fabric. The wash down effect may best be achieved if there is a significant color contrast between the pigment used in the composition and the base color, although no such limitation is required. The coating may be applied at any appreciable level which provides coloration, preferably in sufficient quantity to mask the base color when first applied.

The binder system is characterized by a binder, preferably a predominantly straight chained polymer which, after application to a textile fabric, may be cross-linked or cured, and components selected to facilitate cross-linking, such as catalysts, typically acidic catalysts or acid liberating catalysts, and cross-linking agents. The cross-linking agent may be omitted, especially in the case of self cross-linking binders. The binder is generally cured by heating the fabric, although low-energy curing systems are available which cure at ambient or relatively low temperatures. The pigment/binder system composition may also include miscellaneous modifiers such as thickeners, emulsifiers, solvents and softening agents to improve the hand of the fabric.

Suitable binders include acrylic acid and acylate resins, such as acrylic acid, methacrylic acid, and alkyl esters thereof, alkyl resins, alkyd resins, amino resins, such as urea-formaldehyde and melamineformaldehyde, phenolic resins, such as condensation products of phenols with formaldehyde, polyvinyl condensates, polyurethanes, polyureas, alkylene oxide addition products, and polyolefins containing functional groups susceptible to cross-linking. Particularly useful, are emulsions polymers of acrylic acid, methacrylic acid, acrylates and methacrylates, especially $C_1$–$C_{12}$ alkyl esters, styrene and butadiene, including copolymers and terpolymers thereof, especially those incorporating functional monomers which are either self cross-linking, or which may be cross-linked by incorporation of a suitable cross-linking agent, such as cross-linking agents having reactive isocyanate and formaldehyde groups.

Additionally, the following binders find utility in pigment and binder systems requiring film forming, organic materials which may be applied to the fabric in a liquid form and, upon curing, are capable of adhering the pigment particles to the surface of the fibers which make up the fabric:

Natural binders—albumen, casein, glue, natural resins, starch, gums and alginates; and Synthetic cellulose derivatives-methyl cellulose, ethyl cellulose, nitrocellulose and hydroxyethyl cellulose.

In particular, the following commercial binders may be employed: Rhoplex K-3 TM manufactured by Rohm and Haas Co., a self-crosslinking binder comprising 70 wt % acrylic acids and 30 wt % vinyl acetate, and having the following properties:

Percent solids: 46;
Minimum film formation temperature (°C.): <0;
Ionic charge: nonionic;
pH as packed: 3.0;
Density (lbs/U.S. gal.): 8.7; and
Brookfield viscosity (cP): 50.

the binder compositions and additives cited in Flick, "Textile Finishing Chemicals, An Industrial Guide" (1990). The chemical composition and structure of most commercial binders are proprietary.

There are also a wide range of pigments commercially available for pigment and binder systems. Criteria for use include brilliance, lightfastness and physical characteristics such as particle size and dispersability. The Color Index contains numerous pigments which are readily available and whose preparation and use are well known to those in the field. In particular, organic pigments and metal complexes may be used. The term "pigment", as used herein, is intended to include within its scope vat dyes in their insoluble form, sometimes referred to as vat pigments. Typical particle size of pigments ranges from 0.1 to 2 microns, preferably 0.1 to 1 micron.

Compositions of pigment and binder systems are found in the form of aqueous dispersions systems, solvent dispersion systems, water-in-oil emulsions and oil-in-water emulsions. Preferably, either a water-in-oil or oil-in-water emulsion system is used.

Pigments are generally available in the form of a dispersion, usually having about 40 wt. % pigment solids. Binder emulsions are typically about 50 wt. % solids.

The ratio of pigment and binder in the printing composition has been found to be a critical factor in controlling the degree of fixation of the pigment to the fabric. Relatively less binder is used compared to prior art pigment printing processes. Binder to pigment ratios in the range of from 0.3:1 to 1.5:1 on a solids basis may be used to achieve fixation of only a portion of the pigment, with ranges of 0.4:1 to 1:1 being preferred.

Curing is accomplished when the binder hardens, which preferably includes significant cross-linking, to form a water insoluble film, fixing the pigment to the fibers making up the fabric. Those compositions requiring heat input for curing are generally designed to cure at temperatures ranging from 225° to 375° F. If the composition of pigment and binder has been applied in an emulsion or aqueous solution, the fabric is heated to first drive off the free water followed by continued heating to cure the binder system. As indicated previously, the degree of curing of the binder system is another factor influencing the degree of fixation of the pigment to the fabric. Those with skill in the art may adjust the temperature and time during the curing step to achieve the desired level of fixation of the pigment.

In one embodiment, a heat curable, pigment and binder composition is padded on to a dry, pre-colored fabric at approximately 50 to 100 wt. % wet pickup, preferably 60 to 85 wt % wet pickup based on the dry weight of the fabric. The composition contains: approximately 1-5 g/liter of pigment solids depending on the shade and desired coverage, preferably from 2 to 4 g/liter; approximately 0.25 to 7.5 g/liter of binder solids, preferably from 0.5 to 4 g/liter with the binder being provided in a resin-in-water emulsion; and the balance of the composition is water.

After application of the pigment and binder composition, the fabric is heated to a temperature of 225° to 375° F. for 1 to 8 minutes. Preferably, the fabric is heated to a temperature of 225° to 300° F. for 1 to 4 minutes on a tenter frame in a convection oven. The concentration of binder may be slightly decreased as the curing temperature is increased. Following curing the binder, the fabric may be subjected to standard finishing processes, which include padding with a surface active agent, such as Synfac 8224, and washing the fabric in a series of wash boxes. Finally, softening agents may be applied prior to drying, to improve the hand of the fabric.

Unlike typical textile pigment printing applications, the aim of the present invention is not to maximize the amount of pigment permanently fixed to the fabric. Instead, only a portion of the pigment is permanently fixed to the fabric while the balance of the pigment may be readily removed to expose the base color of the fabric. An aesthetically pleasing wash down effect is achieved by first coating the pre-colored fabric with sufficient pigment and binder composition to substantially mask the base color. For a given binder system, the binder to pigment ratio and degree of curing are controlled to permanently fix from 20 to 80 wt. % of the pigment applied, preferably from 30 to 70 wt. % and most preferably from 40 to 60 wt. %. As used herein, the terms "permanently fix" or "fixed" is intended to refer to pigment which is bound to a fabric during the useful life of a garment made from such fabric, typically 50 machine washings.

The balance of the pigment, which is not fixed to the fabric, may be readily removed by mechanical agitation. In a preferred embodiment, the fabric is made into a garment which is washed in a standard commercial or residential washing machine. As used herein, the term "washing machine" is intended to refer to a common machine used to wash clothes. Abrasive materials, such as pumice of stones, are not required to remove the loosely held pigment, and although they may be used, are not recommended. The abrasive material may not only remove that portion of the pigment which is otherwise fixed, but can also cause physical degradation of the fabric and removal of the base color from the fabric fibers. In addition to machine washing in an aqueous wash solution, the loosely held pigment may be removed by the Laura* process described in EPO Patent Publication No. 0 177 277, published Apr. 9, 1986, which provides a row of computer controlled water jets which can be directed on to a fabric surface.

The invention may be further understood by reference to the following examples, but the invention is not intended to be unduly limited thereby. Unless otherwise indicated, all parts and percentages are by weight.

EXAMPLE 1

The following example demonstrates the preparation and dyeing of a cotton fabric to provide a base color.

A plain weave, cotton fabric of 10 count, open end yarn, characterized by 38 ends per inch and 70 picks per inch, was run on a finishing range. The fabric was subjected to conventional desizing, scouring, bleaching and mercerizing steps followed by washing, neutralization and drying.

The fabric was dyed by padding an aqueous solution of a vat dye (8-10 g/liter in soluble form), an anti-migrating agent, (5.5 g/liter of Cyanatex 655) and water, at a rate of 70 wt. % wet pickup. The fabric was dried at 225° F. for 24 seconds, 250° F. for 24 seconds and 275° F. for 24 seconds. Next, an aqueous, caustic solution containing 60 g/liter of sodium hydroxide and 30 g/liter of hydrosulfite was padded on to the fabric at a 70 wt. % wet pickup rate and the fabric was steamed at 220° F. for 90 seconds. Last, the fabric was run through an oxidizing wash containing hydrogen peroxide and acetic acid, washed and dried.

EXAMPLE 2

The following example demonstrates application of a pigment and binder composition to a pre-colored fabric.

To the fabric of Example 1, a pigment and binder composition was padded on at a 70 wt. % wet pickup rate. The composition, an oil-in-water emulsion, contained:

7-8 g/liter of vat dye in insoluble form dispersed in an aqueous phase (40% solids); and 4 g/liter of an acrylic resin emulsion sold under the trademark 'RHOPLEX K-3', manufactured by Rhom and Haas Company (46% solids).

The fabric was dried on a tenter frame in a convection oven at 225° F. for 24 seconds, 250° F. for 24 seconds and 275° F. for 24 seconds. After drying, the fabric was padded with a surface active agent, 5 g/liter of Synfac 8224 in an aqueous solution, 70 wt. % wet pickup, and run through 7 wash boxes. The fabric was finished by padding with a 6% solution of Velvetol SCL, a softening agent, and dried at 260° F.

EXAMPLE 3

The following example demonstrates a technique for removal of pigment which has not been fixed to the fabric.

The fabric of Example 2 was made into a pair of trousers. The trousers were placed alone in a Kenmore 80 Series Model washing machine, and washed on Cotton/Sturdy cycle at 120° to 180° F. for 14 minutes without detergent. After washing, the trousers were tumbled dry at medium heat in a Kenmore drier for 20 minutes.

The percentage of pigment removed from the fabric was determined on a Hunter Labscan Colorimeter by comparing values of the fabric before (control) and after washing (treated). The "L" value of the control and treated fabric were 27.94 and 29.30 respectively, which correlates to an approximate 40% color loss after one washing.

There are, of course, many alternate embodiments and modifications which are intended to be included within the scope of the following claims.

What I claim is:

1. A process for treating a textile fabric, comprising the steps of:

providing a textile fabric which has been dyed, or is constructed of pre-dyed fiber, to give said fabric a first color;

applying a pigment and binder composition to a side of said fabric, said composition having from 2 to 4 g/l of pigment and 0.5 to 4 g/l of binder on a solid basis, wherein said pigment has a second color which is different from said first color, said binder is a film forming polymer selected from acrylic and acrylate resins, alkyl resins, alkyd resins, amino resins, phenolic resins, polyvinyl condensates, polyurethanes, polyureas, alkylene oxide addition products, and polyolefins and co-polymers thereof containing functional groups which may be cross-linked, and said composition is applied to said fabric at the rate of 50 to 100 wt. % wet pickup based on the weight of said fabric;

heating said fabric to a temperature of 225° to 300° F. for 1 to 4 minutes to cure said binder and fix between 30 to 70 wt. % of said pigment to said fabric; and washing said cured fabric to remove a balance of said pigment not permanently fixed to said fabric, thereby exposing said first color.

2. The process of claim 1 wherein said pigment and binder composition is uniformly applied to said side of said fabric.

3. The process of claim 2 wherein said pigment and binder composition is applied to said fabric at the rate of 60 to 85 wt. % wet pickup.

4. The process of claim 3 wherein said composition is an emulsion and said binder is selected from polymers of acrylic acids, methacrylic acid, acrylates and methacrylates, and copolymers thereof.

5. A process for treating a textile fabric, comprising the steps of:

providing a textile fabric which has been dyed, or is constructed of pre-dyed fiber, to give said fabric a first color;

applying a pigment and binder composition to a side of said fabric, said composition having a binder to pigment ratio of from 0.3:1 to 1.5:1, wherein said pigment has a second color which is different from said first color, said binder is a film forming polymer selected from acrylic and acrylate resins, alkyl resins, alkyd resins, amino resins, phenolic resins, polyvinyl condensates, polyurethanes, polyureas, alkylene oxide addition products, and polyolefins and co-polymers thereof containing functional groups which may be cross-linked, and said composition is applied to said fabric at the rate of 50 to 100 wt. % wet pickup based on the weight of said fabric;

heating said fabric to a temperature of 225° to 375° F. for 1 to 8 minutes to cure said binder and fix between 20 to 80 wt. % of said pigment to said fabric; and mechanically agitating said cured fabric to remove a balance of said pigment not permanently fixed to said fabric, thereby exposing said first color.

6. The process of claim 5 wherein said binder to pigment ratio is between 0.4:1 to 1:1 and said composition is applied to said fabric at the rate of 60 to 85 wt. % wet pickup based on the weight of said fabric.

7. The process of claim 6 wherein said fabric is heated to a temperature of 225° to 300° F. for 1 to 4 minutes to cure said binder and fix between 40 to 60 wt. % of said pigment to said fabric.

8. The process of claim 7 wherein said composition is an emulsion and said binder is selected from polymers of acrylic acids, methacrylic acid, acrylates and methacrylates, and copolymers thereof.

9. The process according to claim 8 wherein said mechanical agitation comprises washing said fabric in an aqueous solution.

* * * * *